United States Patent [19]

Novak

[11] Patent Number: 4,606,773

[45] Date of Patent: Aug. 19, 1986

[54] EMULSIFICATION OF ALKENYL SUCCINIC ANHYDRIDE SIZING AGENTS

[75] Inventor: Robert W. Novak, Lisle, Ill.

[73] Assignee: Nalco Chemical Company, Oak Brook, Ill.

[21] Appl. No.: 679,840

[22] Filed: Dec. 10, 1984

[51] Int. Cl.[4] ..... B01J 13/00; C08J 3/02

[52] U.S. Cl. ..... 106/213; 162/168.3; 252/312; 252/314

[58] Field of Search ..... 252/312; 106/213; 162/168.3

[56] References Cited

U.S. PATENT DOCUMENTS 3,102,064 8/1963 Wurzburg et al. ..... 162/158
4,040,900 8/1977 Mazzarella et al. ..... 162/158

FOREIGN PATENT DOCUMENTS 3105903 9/1982 Fed. Rep. of Germany ... 162/168.3

OTHER PUBLICATIONS

J. E. Unbehend et al., "17 Retention Chemistry", *Pulp and Paper Chemistry and Chemical Technology,* 3rd Edition, vol. III, J. P. Casey, Editor, John Wiley & Sons, New York, 1981, pp. 1593–1607.

*Primary Examiner*—Richard D. Lovering
*Attorney, Agent, or Firm*—John G. Premo; Robert A. Miller; Donald G. Epple

[57] ABSTRACT

Emulsion of alkenyl succinic anhydride sizing agents are prepared using a cationic water-soluble polymer and a cationic starch as an emulsifier.

7 Claims, No Drawings

EMULSIFICATION OF ALKENYL SUCCINIC ANHYDRIDE SIZING AGENTS

INTRODUCTION

Alkenyl succinic anhydrides (ASA) useful in the sizing of cellulosic materials have gained considerable commercial success. These materials were first fully disclosed in U.S. Pat. No. 3,102,064 which is hereinafter incorporated by reference. This patent discloses a certain class of chemical materials generally having the structural formula

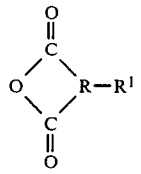

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

In describing the use of the ASA sizes disclosed in this reference, the patentee indicates that for effective utilization, the sizing agents must be used in conjunction with a material which is either cationic in nature or is, on the other hand, capable of ionizing or disassociating in such a manner to produce one or more cations or other positively charged groups. The cationic agents as they are defined in this reference are disclosed as "alum, aluminum chloride, long chain fatty amines, sodium aluminate, polyacrylamide, chromic sulfate, animal glue, cationic thermosetting resins, and polyamide polymers". The patentee particularly points out as preferred cationic agents various cationic starch derivatives including primary, secondary, tertiary, or quaternary amine starch derivatives and other cationic nitrogen substituted starch derivatives, as well as cationic sulfonium and phosphonium starch derivatives. Such derivatives, as stated by the patentee, may be prepared from all types of starches including corn, tapioca, potato, etc.

With the growing commercial use of sizes of the type above described, serious problems have remained in the application of the sizes to paper stock or pulp prior to its formation into sheet or other useful forms. Part of the problem has been that the ASA sizing materials are not water soluble, and must, accordingly, be uniformly suspended in the pulp so that the size can make adequate contact with the cellulosic fibers and thus create the desired effect on the final product.

Another problem has been in the use of the ASA sizing agent which are typically homogenized at the use site with cationic wet end starches. The resulting emulsions are generally mechanically stable and do not separate into an oil phase and an aqueous phase when diluted. Although this is an example of a method of introducing ASA sizing into the pulp system, the procedure requires equipment for cooking or dispersing the starch and holding it at a fairly low concentration, generally 2–4 percent.

Recently, work has been conducted to eliminate the problems associated with handling starch used to emulsify ASA size at the paper mill site. This work has included the use of cationic water-soluble polymers such as those described in commonly assigned Ser. No. 625,476, filed June 25, 1984 and now abandoned. While most polymer systems of the type described in that application form excellent emulsions with ASA size, the emulsions tend to separate with time.

We have now found, however, that incorporating an amount of starch into the polymer as an emulsifier enhances the stability of the ASA emulsion formed. The starch can be cooked or dispersed at a relatively high solids level and blended with the desired polymer. The polymer-starch blend can then be used with a minimum of equipment to obtain the proper solids content for emulsification of the ASA size.

It is accordingly an object of this invention to provide to the art a polymer-starch additive which will serve to emulsify or disperse ASA size in the pulp and allow for retention of the ASA size onto the fiber.

Further objects will appear hereinafter.

THE INVENTION

This invention, as briefly stated above, is to use a blend of cationic water-soluble polymer and a starch as an additive or emulsifying agent for ASA sizes. The use of cationic addition polymer-starch blends as emulsifying agents for ASA size improves stability of the ASA size, and eliminates expensive mixing equipment while simplifying addition compared to the use of starch alone.

The ASA sizes to which this invention is applicable include these mentioned in U.S. Pat. Nos. 3,102,064, 4,040,900, 3,968,005, and 3,821,069, all of which are hereinafter incorporated by reference.

The ASA sizes useful in the subject of this invention are generally described by the following structural formula:

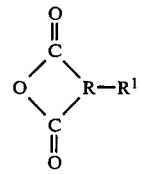

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

In a particular useful embodiment of this invention, a surfactant has also been employed in making the ASA sizes of this invention. This surfactant may be anionic, non-ionic, or cationic in nature. Surfactants employed have generally been water soluble and have had HLB values ranging from about 8 to about 30 or higher, and preferably from about 8–15. The surfactant is generally used to prepare the ASA size by simply mixing it with the raw ASA material. The ASA size used in this invention accordingly, and in a preferred embodiment of this invention, will generally contain 75–99.5 parts by weight of ASA and preferably 90–99 parts by weight of ASA with 0.5–25 parts, preferably 0.75–10 parts, and most preferably 1.0–5 parts by weight of surfactant.

The surfactants are preferably added to the ASA prior to emulsification in the aqueous medium. Surfactant can also be added to the aqueous medium prior to the addition of the ASA.

The surfactants useful in this invention are further described in U.S. Pat. No. 4,040,900 hereinafter incorporated by reference into this specification. The relevant parts of U.S. Pat. No. 4,040,900 begin at column 4, line 54 continue through column 5, line 46. Other portions of this patent are, however, relevant.

Classes of materials useful as the surfactants in this invention include: ethoxylated alkyl phenols, such as nonyl phenoxy polyethoxy ethanols and octyl phenoxy polyethoxy ethanols; poly ethyleneglycols such as PEG 400 mono-oleate, and PEG 600 dilaurate; as well as other materials including certain ethoxylated phosphate esters.

Preferred surfactants for use in our invention are GAFAC RM510 and GAFAC RE610, both free acids of complex organic phosphate esters, manufactured by the GAF Corporation.

THE WATER SOLUBLE POLYMERS

Water soluble polymers which are useful cationic agents in this invention include water soluble vinyl addition homopolymers and copolymers having molecular weights greater than 10,000 and below 1,000,000 where at least 10 weight percent and up to 100 weight percent of the mer content of the polymer is a cationic monomer, or cationically modified monomer. Preferably at least 15 and up to 95 weight percent of the mer units in the polymer may be cationic or cationically modified monomers. Most preferably from 20–75 weight percent by weight of the mer units in the polymer or copolymer are cationic or cationically modified.

The vinyl polymers selected for use in this invention generally have a molecular weight of greater than 10,000 and less than 1,000,000. Polymers of this type should generally be water soluble, and a preferred molecular weight has been found to be between 20,000 and 750,000. Most preferably, the molecular weights of the polymers employed range from 50,000 to 150,000.

Polymers which can be employed in the practice of this invention include, but are not limited to the following exemplary copolymers and homopolymers:

acrylamide-dimethylaminoethylacrylate,
acrylamide-dimethylaminoethylacrylate quaternaries,
acrylamide-diethylaminoethylacrylate,
acrylamide-diethylaminoethylacrylate quaternaries,
acrylamide-dimethylaminoethylmethacrylate,
acrylamide-dimethylaminoethylmethacrylate quaternaries,
acrylamide-diallyldimethyl ammonium chloride,
polydiallyl-dimethyl ammonium chloride,
polydimethylaminoethylmethacrylate and its quaternaries,
polymethacrylamidopropyltrimethyl ammonium chloride; and,
acrylamide-methacrylamidopropyltrimethyl ammonium chloride.

Also useful are polymers and copolymers of acrylamide which have been subjected to a "Mannich" reaction with formaldehyde and a lower alkyl secondary amine. These polymers may or may not be quaternized.

Also useful in the subject invention are cationic condensation polymers. Polymers of this type such as those prepared from ethylenedichloride and ammonia, epichlorohydrin and dimethylamine, epichlorohydrin, dimethylamine and ammonia, etc. will be useful in the subject invention. These condensation polymers will generally have a lower molecular weight than vinyl addition polymers employed, but will work nevertheless.

As seen, all of the polymers useful in this invention are cationically charged and are water-soluble. Many are prepared from vinyl addition monomers, although condensation polymers will also work. Since the number of possible cationically charged monomers that will produce a water soluble polymer is essentially unlimited, and it is expected that all water-soluble cationically charged vinyl addition polymers having a molecular weight of 10,000 or more but less than 1,000,000 will work, we do not wish to be limited to the above given list.

The polymers employed, as stated above, may be copolymers and even terpolymers of various vinyl addition monomers. While acrylamide is a preferred nonionic monomer for use in preparing copolymers useful in this invention, other nonionic monomers such as methacrylamide and even certain anionically charged monomers such as acrylic acid, methacrylic acid, various sulfonated water soluble vinyl addition monomers, etc. can be employed.

Polymers as used in this invention may be in the form of water-in-oil emulsions (such as those described in U.S. Pat. Nos. Re. 28,474 and 28,576, both of which are hereinafter incorporated by reference), dry powders, or dilute aqueous solutions. In order to employ the polymers of the subject invention in the emulsification of ASA sizes, an aqueous solution must first be prepared of the polymer. In the case of the water-in-oil emulsions of vinyl addition polymers, we have found the water soluble surfactants used to invert the water-in-oil emulsions have no detrimental effect on the activity of the polymer used to emulsify the ASA size. When preparing a polymer solution from a water-in-oil emulsion polymer, a useful method or device for forming the solution is exemplified in U.S. Pat. No. 4,057,223 which discloses a mixing block.

Depending upon the molecular weight and cationic charge of the polymer, from 0.01% to 25%, and preferably 0.01–10% by weight of the final size emulsion to be added to the pulp furnish may be polymer.

THE STARCH COMPONENT

Starch useful as an emulsifier for the ASA size in this invention may be any cationic starch. Cationic starches useful in this invention are disclosed in U.S. Pat. Nos. 4,029,885, 4,146,515, 3,102,064, and 3,821,069, all of which are hereinafter incorporated by reference.

Also of note are U.S. Pat. Nos. 3,223,543 and 3,223,544 which teach the use of cationic starches, an emulsification media, for fatty acid anhydride and alkyl ketene dimer. These patents are also hereinafter incorporated by reference.

Preferred starches useful in this invention are cationic potato starch and cationic corn starch. Materials of this type are available commercially as for example from A. E. Staley Corporation designated STALOK 400 (potato) and CATO F from National Starch Co. (corn).

The ASA emulsions fed to the pulp slurry, according to this invention, will generally contain:

40–99.9 percent by weight water
0.01–50 percent by weight ASA
0.001–25 percent by weight of the water-soluble polymer, and
0.001–25 percent by weight of the cationic starch.

Preferably these emulsions will contain:

40–99.9 percent water 0.01–40 percent ASA
0.010–10 percent polymer, and
0.010–10 percent starch.

Most preferably the ASA emulsion contains 0.01–10.0 generally 0.01–7.5 and preferably 0.01–6.0 parts of a 25:75 to 72:25 starch-polymer mixture.

The polymer-starch additives of this invention are used to emulsify the ASA. The polymer-starch mixtures of this invention will increase the performance of the emulsion compared to emulsions not containing the polymer-starch additive. The polymer-starch mixtures, when added during the makeup of the ASA emulsion, require no additional emulsifier.

Also within the scope of this invention is the addition of polymer-starch mixtures to already formed ASA emulsions. When added to previously formed ASA emulsions, care should be taken to produce a stable emulsion, and other additives may have to be employed. As an example, in a previously formed ASA emulsion having been made with GAFAC-610 with no additional emulsifiers, the ASA particles in the emulsion will be large and the emulsion will be unstable. Adding polymer-starch mixtures may further stabilize this emulsion. If, however, the same components are used to initially prepare the ASA emulsion, a stable emulsion generally results.

In order to test the subject invention, the following experiments were conducted.

EXAMPLE 1

A 14 percent by weight water slurry of STALOK 400, a cationic potato starch available from A. E. Staley Company, was passed through a jet cooker, maintained at about 300° F. at a rate of about 0.1–0.2 gallons per minute and then allowed to cool to 140° F. To 2000 grams of this cooked starch was added 800 grams of a 37 percent aqueous solution of a commercially available epichlorohydrin-dimethylamine copolymer which had been cross-linked with a small amount of ammonia. Polymers of this type are described in U.S. Pat. Nos. Re. 28,807 and 28,808 to the American Cyanamid Company.

The mixture was blended by simple stirring, and then passed through a turbine pump at approximately 100 psi with at least 50 percent recycle. The resulting blend was then treated with 300 parts per million of a water-soluble biocide as a preservative and then allowed to cool to room temperature. This material is hereinafter referred to as Example 1.

EXAMPLE 2

To 350 grams of a 24 percent aqueous solution of a 75:25 weight percent copolymer of acrylamide and dimethylaminoethylmethacrylate quaternary was mixed 400 grams of a 10 percent pregelatinized cationic potato starch. The product formed a homogeneous blend by simple mixing. Approximately 300 parts per million of a water-soluble preservative was also added to this material. This material is hereinafter referred to as Example 2.

EXAMPLE 3

To 350 grams of a 24 percent solution of a 75:25 weight percent copolymer of acrylamide and methacrylamidopropyltrimethylammonium chloride was mixed 400 grams of a 10 percent pregelatinized potato starch. The product formed a homogeneous blend by simple mixing. This product was also stabilized with approximately 300 parts per million of a water-soluble preservative. This material is hereinafter referred to as Example 3.

EXAMPLE 4

This example shows the preparation of ASA emulsions using the compositions of Examples 1–3. The ASA size employed contain 99.25 percent of alkenyl succinic anhydride and 0.75 percent of GAFAC RE-610 surfactant.

An ASA emulsion was prepared with an epichlorohydrin-dimethylamine copolymer using an 8 oz. Osterizer "minicup" with the following formulation:

20 grams of ASA emulsion, 180 grams of 5 percent aqueous solution of the dimethylamine-epichlorohydrin polymer used in Example 1.

This material was called Emulsion A. Emulsion A was diluted by two methods to 5.0 and 0.5 percent ASA size. In method one, 100 grams of Emulsion A was diluted with 100 grams of 5 percent solids dimethylamine-epichlorohydrin copolymer used in Example 1 and called Emulsion B. Ten grams of Emulsion B was then diluted further with 90 grams of deionized water and called Emulsion C. In the second method, 5.0 grams of Emulsion A was mixed with 5.0 grams of 5 percent solids epichlorohydrin-dimethylamine copolymer and 89.5 grams of deionized water and called Emulsion D.

A 5 percent ASA emulsion was prepared with the starch/epichlorohydrin dimethylamine copolymer composition of Example 1. The emulsion consisted of 14 parts ASA size, and 69 parts of the starch/epichlorohydrin dimethylamine polymer and 197 grams of deionized water and called Emulsion E. Emulsion E was diluted to 0.5 percent ASA with deionized water and called Emulsion F. The Emulsions B–F were heated to 150° F. for an accelerated aging test. The results are listed in Table I below.

TABLE I

COMPARISON OF EMULSIONS CONTAINING POLYMER/STARCH MIXTURES

| Emulsion | % ASA | % Epichlorohydrin dimethylamine copolymer | % Epichlorohydrin dimethylamine copolymer/starch blend of Ex. 1 | Appearance 1 hr. at 150° F. |
|---|---|---|---|---|
| B | 5. | 5 | — | no change |
| C | 0.5 | 0.5 | — | split into oil |
| D | 0.5 | 0.5 | — | split into oil |
| E | 5. | — | 5. | no change |
| F | 0.5 | — | 0.5 | sl. white prec. |

EXAMPLE 5

ASA emulsions were prepared with acrylamide copolymer starch blends cited in Examples 2 and 3 and the corresponding copolymers above. The emulsions consisted of 5 percent ASA and 1 percent copolymer solids of the copolymer starch blends and the corresponding copolymers alone. The emulsions were compared as is and diluted to 0.5 percent ASA and compared in an accelerated aging test at 150° F. The results are shown in Table II.

TABLE II

COMPARISON OF ASA EMULSIONS CONTAINING ACRYLAMIDE COPOLYMERS AND ACRYLAMIDE COPOLYMER STARCH BLENDS CITED IN EXAMPLES 2 AND 3

| Emulsion | % ASA | % Copolymer | % Copolymer Starch-Blend[1] | Appearance 1 hr. at 150° F. |
|---|---|---|---|---|
| G | 5 | 1* | — | V. sl. prec. on walls |
| G | 0.5 | 0.1* | — | Sl. circle of film |
| H | 5 | — | 1 (Ex. 2) | no change |
| H | 0.5 | — | 0.1 (Ex. 2) | no change |
| I | 5 | 1** | — | no change |
| I | 0.5 | 0.1** | — | Sl. circle of film |
| J | 5 | — | 1 (Ex. 3) | no change |
| J | 0.5 | — | 0.1 (Ex. 3) | V.V. sl. circle of film |

[1]The solids content is based on the copolymer content in the copolymer starch blend
*(ACAM/DMAEMQ)
**(ACAM/MAPTAC)

Even more dramatic is the appearance of the emulsions maintained at room temperature. After a few days the emulsion containing the acrylamide dimethylaminoethylmethacrylate quaternary copolymer had broken completely, but the emulsion with its corresponding starch-blend remained intact. The emulsion containing the acrylamide methacrylamidopropyl trimethylammonium chloride copolymer formed a floating oil layer but the emulsion with its corresponding starch blend remained intact.

EXAMPLE 6

In the same manner as Example 1, an 11 percent by weight water slurry of CATO-F, a cationic corn starch available from National Starch Company was cooked at 200° F. for one hour. The starch was cooled to 140° F. and 200 grams was blended in an Osterizer "minicup" with 80 grams of a 47 percent aqueous solution of a commercially available epichlorohydrin-dimethylamine copolymer which had been cross-linked with a small amount of ammonia. Polymers of this type are described in U.S. Pat. Nos. Re. 28,807 and 28,808 to the American Cyanamid Company.

The resulting blend was then treated with 300 ppm of a water-soluble biocide as a preservative and then cooled to room temperature. This material is hereinafter referred to as Example 6.

EXAMPLE 7

To 350 grams of a 20 percent aqueous solution of a 75:25 weight percent copolymer of acrylamide and dimethylaminoethylmethacrylate quaternary was mixed 400 grams of the CATO-F starch prepared in Example 6. Approximately 300 ppm of a water-soluble preservative was added to this material. This material is hereinafter referred to as Example 7.

EXAMPLE 8

To 350 grams of a 24 percent solution of a 75:25 weight percent copolymer of acrylamide and methacrylamidopropyl trimethylammonium chloride was mixed 400 grams of the CATO-F starch prepared in Example 6. Approximately 300 ppm of a water-soluble preservative was added to this material. This material is hereinafter referred to as Example 8.

EXAMPLE 9

ASA emulsions were prepared with the copolymer starch blends prepared in Examples 6, 7, and 8, and the corresponding copolymers above. The emulsions consisted of 5 percent ASA and 1 percent copolymer solids of the copolymer starch blends and the corresponding copolymers alone. The emulsions were compared as is and diluted to 0.5 percent ASA and compared in an accelerated aging test at 150° F. The results are shown in Table III.

When the emulsions maintained at room temperature were examined the next day, the one containing the copolymer starch blend from Example 8 showed no change while that containing the copolymer alone was beginning to split into an oil. The emulsion containing the acrylamide methacrylamidopropyl trimethylammonium chloride copolymer alone showed a greater degree of splitting into an oil than the corresponding copolymer starch blend of Example 7. The dimethylamine-epichlorohydrin copolymer was split into an oil to the highest degree, while the corresponding copolymer starch blend of Example 8 either showed no change or a very slight oil ring forming.

TABLE III

COMPARISON OF ASA EMULSIONS CONTAINING COPOLYMERS AND COPOLYMER: CATO F STARCH BLENDS CITED IN EXAMPLES 6, 7, AND 8

| Emulsion | % ASA | % Copolymer | % Copolymer Starch Blend[1] | Appearance 1 Hr at 150° F. |
|---|---|---|---|---|
| K | 5 | 1.2* | — | Split into oil |
| K | 0.5 | 0.12* | — | No change |
| L | 5 | — | 1.2 (Ex. 8) | No change |
| L | 0.5 | — | 0.12 (Ex. 8) | No change |
| M | 5 | 1.** | — | Split into oil |
| M | 0.5 | 0.1** | — | Split into oil |
| N | 5 | — | 1 (Ex. 7) | No change |
| N | 0.5 | — | 0.1 (Ex. 7) | No change |
| O | 5 | 2.5*** | — | Split into oil |
| O | 0.5 | 0.25*** | — | Split into oil |
| P | 5 | — | 2.5 (Ex. 6) | No change |
| P | 0.5 | — | 0.25 (Ex. 6) | Very sl. oil |

[1]The solids content is based on the copolymer content in the copolymer: starch blend
*(ACAM/MAPTAC)
**(ACAM/DMAEMQ)
***(DMA/EPI)

Based on the above results, ASA emulsions prepared according to the subject invention are mechanically stable, and do not separate into an oil phase and an aqueous phase when diluted. Elimination of expensive mixing equipment is accomplished using this invention, and since starch does not have to be cooked or dispersed at the use site, the ease of using ASA size is greatly increased.

One of the most interesting aspects of the subject invention is that while the cationic starch-cationic polymer blend stabilize the ASA emulsions, the polymer-starch blends themselves are also quite stable. This stability imparted to the additives of this invention aids in their application and helps to eliminate expensive mixing equipment, etc. when the polymer starch mixtures are used to produce ASA emulsions particularly for paper sizing applications.

By the use of the polymer-starch mixtures of this invention, better emulsification is achieved over either starch, and/or polymer alone.

Having thus described my invention, I claim:

1. In a method for emulsification of alkenyl succinic anhydride type paper sizing wherein a water-soluble polymer is used as an emulsification aid, the improvement comprising using as the water-soluble polymer a cationically modified polymer having a molecular weight ranging between 20,000–750,000 in conjunction with a water-soluble cationic starch, and wherein the cationic starch to polymer weight ratio is between 75:25 to 25:75.

2. The improvement of claim 1 wherein the cationic starch is a cationic potato starch.

3. The improvement of claim 1 wherein the cationic starch is a cationic corn starch.

4. An alkenyl succinic anhydride emulsion containing:

40–99.9 percent by weight water 0.01–40 percent by weight ASA 0.01–10 percent by weight of a water-soluble cationically modified polymer having a molecular weight ranging between 20,000–750,000, and 0.01–10 percent by weight of a cationic starch, and wherein the cationic starch to polymer weight ratio is between 75:25 to 25:75.

5. The emulsion of claim 4 wherein the starch is a cationic potato starch.

6. The emulsion of claim 4 wherein the starch is a cationic corn starch.

7. A method of forming an emulsion of an alkenyl succinic anhdyride in water which comprises dispersing from 0.01–40 weight percent of alkenyl succinic anhydride in water and adding to such suspension from 0.01–7.5 weight percent of an aqueous solution containing from 25:75 to 75:25 by weight of a cationic starch and cationic water-soluble polymer having a molecular weight between 20,000–750,000 so as to provide from 0.010–10 weight percent of the polymer in the emulsion.

* * * * *